US010322854B1

(12) United States Patent
Wang

(10) Patent No.: US 10,322,854 B1
(45) Date of Patent: Jun. 18, 2019

(54) QUICK-DETACHABLE AND REPLACEABLE WET TISSUE FLAP COVER

(71) Applicant: Top Green World Packaging Co., Ltd., Gelu (CN)

(72) Inventor: Ling-da Wang, Gelu (CN)

(73) Assignee: TOP GREEN WORLD PACKAGING CO., LTD., Shanghai (CN)

( * ) Notice: Subject to any disclaimer, the term of this patent is extended or adjusted under 35 U.S.C. 154(b) by 0 days.

(21) Appl. No.: 15/947,239

(22) Filed: Apr. 6, 2018

(30) Foreign Application Priority Data

Nov. 30, 2017 (CN) ..... 2017 2 16426164 U

(51) Int. Cl.

| | |
|---|---|
| ***B65D 47/08*** | (2006.01) |
| ***B65D 45/18*** | (2006.01) |
| ***B65D 43/02*** | (2006.01) |
| *A47K 10/32* | (2006.01) |
| *B65D 83/08* | (2006.01) |

(52) U.S. Cl.
CPC ..... *B65D 47/0809* (2013.01); *B65D 43/0239* (2013.01); *B65D 45/18* (2013.01); *A47K 2010/3266* (2013.01); *B65D 83/0805* (2013.01)

(58) Field of Classification Search
CPC ..... B65D 47/0809; B65D 47/0823; B65D 47/0828; B65D 47/0804; B65D 47/08; B65D 45/18; B65D 45/16; B65D 43/0239; B65D 43/0237; B65D 43/164; B65D 43/16; B65D 43/166; B65D 43/168; B65D 83/0835; B65D 83/0805; B65D 43/0216; B65D 43/0214; B65D 43/0204; A47K 10/32
USPC .... 220/837, 838, 836, 847, 810, 840, 254.5, 220/254.3, 254.7, 259.1, 256.1, 797, 796, 220/795, 780; 206/233
See application file for complete search history.

(56) References Cited

U.S. PATENT DOCUMENTS 2,575,490 A * 11/1951 Condon ..... B65D 43/022 220/801
3,342,190 A * 9/1967 Hultgren ..... A45D 40/22 132/301
4,349,120 A * 9/1982 DiNardo ..... B65D 43/164 16/267

(Continued)

FOREIGN PATENT DOCUMENTS

GB 440345 A * 12/1935 ..... B65D 43/164

*Primary Examiner* — Robert J Hicks
(74) *Attorney, Agent, or Firm* — Muncy, Geissler, Olds & Lowe, P.C.

(57) ABSTRACT

The invention discloses a quick-detachable and replaceable wet tissue flap cover, comprising an upper flap cover and a lower withdrawal cover, a hinge structure is arranged at a joint between said upper flap cover and said lower withdrawal cover, a clamping slot connected with said hinge structure is arranged at the joint between said lower withdrawal cover and said upper flap cover, said clamping slot is elastically clamped with said hinge structure, and said upper flap cover is reversibly open and closed relative to said lower withdrawal cover. The quick-detachable and replaceable wet tissue flap cover of the invention has the advantages of simple structure and convenient use, guaranteeing the tightness, safety and hygiene, and avoiding bacteria breeding and moisture loss of wet tissues.

4 Claims, 1 Drawing Sheet

(56) References Cited

U.S. PATENT DOCUMENTS

| | | | | | |
|---|---|---|---|---|---|
| 4,746,031 | A * | 5/1988 | Grandmottet | A45D 40/22 | 220/836 |
| 5,357,565 | A * | 10/1994 | Butler, III | E05D 11/0054 | 16/250 |
| 5,542,567 | A * | 8/1996 | Julius | A47K 10/421 | 221/46 |
| 6,068,153 | A * | 5/2000 | Young | B65D 15/24 | 220/254.3 |
| 6,772,899 | B2 * | 8/2004 | Delmon | A45D 40/221 | 132/295 |
| 2003/0159403 | A1 * | 8/2003 | Verespej | B65B 61/186 | 53/412 |
| 2006/0086757 | A1 * | 4/2006 | Robinson | B65D 47/0804 | 222/153.14 |
| 2009/0050504 | A1 * | 2/2009 | Stechschulte | B65D 47/0871 | 206/459.5 |
| 2009/0321299 | A1 * | 12/2009 | Gehring | A47K 10/42 | 206/581 |
| 2011/0011767 | A1 * | 1/2011 | Gehring | B65D 83/0811 | 206/581 |
| 2016/0113450 | A1 * | 4/2016 | Yamada | A47K 10/423 | 221/1 |

* cited by examiner

QUICK-DETACHABLE AND REPLACEABLE WET TISSUE FLAP COVER

TECHNICAL FIELD

The invention relates to a flap cover, in particular to a quick-detachable and replaceable wet tissue flap cover.

DESCRIPTION OF THE RELATED ART

Each of existing wet tissue flap covers comprises an upper flap cover and a lower withdrawal cover, and the upper flap cover and the lower withdrawal cover are mainly connected in the following two modes:

1. The upper flap cover and the lower withdrawal cover are integrated to form a collapsible connection. The disadvantage is that the connection breaks after repeated turnover or pull. Once the connection breaks, the upper flap cover and the lower withdrawal cover are separated and can not be replaced, thereby seriously affecting the tightness of the wet tissue flap cover.

2. The upper flap cover and the lower flap cover are connected by a connecting shaft or connecting rod. After repeated use, the connecting shaft or connecting rod breaks easily, thus, the upper flap cover and the lower flap cover cannot be connected and replaced.

The wet tissue flap covers of the above two structures have such problems when used, as a result, the upper flap cover and the lower withdrawal cover are separated and cannot be connected again, which will seriously affect the tightness of the wet wipe flap covers, result in moisture loss of wet tissues, and affect the use effect of wet tissues, resulting in bacteria breeding, and affecting the safety and hygiene of wet tissues.

SUMMARY OF THE INVENTION

Due to the problems in the prior art, the invention provides a quick-detachable and replaceable wet tissue flap cover to prevent connection failure, moisture loss of wet tissues and bacteria breeding due to separation of an upper flap cover from a lower withdrawal cover.

The invention solves the problems by the following technical solution:

A quick-detachable and replaceable wet tissue flap cover, comprising an upper flap cover and a lower withdrawal cover, and characterized in that a hinge structure is arranged at a joint between said upper flap cover and said lower withdrawal cover, a clamping slot connected with said hinge structure is arranged at the joint between said lower withdrawal cover and said upper flap cover, said clamping slot is elastically clamped with said hinge structure, and said upper flap cover is reversibly open and closed relative to said lower withdrawal cover.

Preferably, said hinge structure comprises two parallel support portions and a hinge shaft with both ends fixed at said support portions respectively, and said support portions are fixed at the joint between the upper flap cover and the lower withdrawal cover; said hinge shaft is a cylindrical rod arranged at a spacing from said upper flap cover, and said clamping slot is extended in the spacing and elastically clamped with said hinge shaft.

Preferably, said clamping slot is integrated with said lower withdrawal cover by an elastic material, an opening of said clamping slot faces downward, and said hinge shaft is inserted into or pulled out of the opening.

Preferably, an oval wet tissue withdrawal opening is formed on said lower withdrawal cover, a raised ring wall is formed at an edge of said withdrawal opening, and an upper surface of said ring wall is closely fitted with a lower surface of said upper flap cover when said upper flap cover and said lower withdrawal cover are closed, preventing ingress of external dust and impurities, and keeping wet tissues clean and sanitary.

With the technical means, the application improves the connecting structure between the upper flap cover and the lower withdrawal cover. The arrangement of the hinge structure and the clamping slot on said upper flap cover and said lower withdrawal cover respectively helps avoid the problems that the upper flap cover and the lower withdrawal cover of an existing wet tissue flap cover break easily and cannot be replaced, and realize quick detachment and replacement of the wet tissue flap cover, thus guaranteeing the tightness, safety and hygiene of the wet tissue flap cover, avoiding bacteria breeding and moisture loss of wet tissues, and guaranteeing the use effect of wet tissues by users.

DESCRIPTION OF THE PREFERRED EMBODIMENT

The technical solution of the invention will be further described in detail in combination with examples and drawings.

Figure 1:
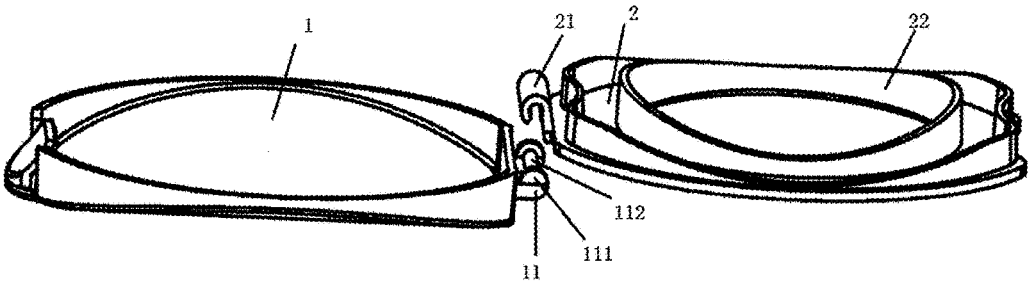
FIG. 1 is a breakdown structure diagram of the invention.
Figure 2:
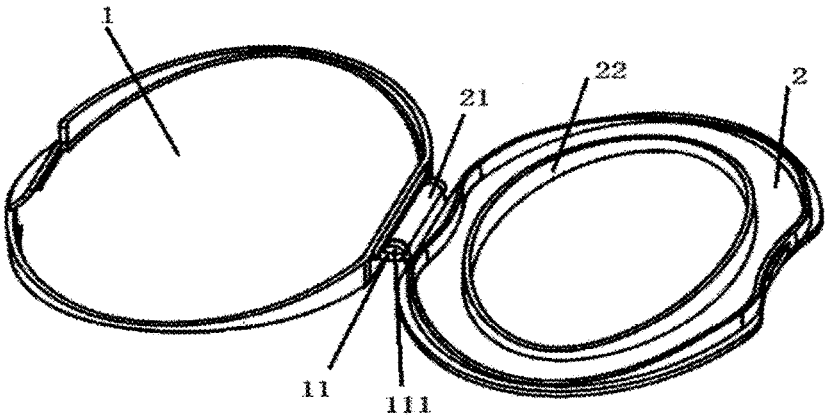
FIG. 2 is an overall structure diagram of the invention.

As shown in FIG. 1 and FIG. 2, a quick-detachable and replaceable wet tissue flap cover of the invention comprises an upper flap cover 1 and a lower withdrawal cover 2. A hinge structure 11 is arranged at a joint between said upper flap cover 1 and said lower withdrawal cover 2, a clamping slot 21 connected with said hinge structure 11 is arranged at the joint between said lower withdrawal cover 2 and said upper flap cover 1, said clamping slot 21 is elastically clamped with said hinge structure 11, and said upper flap cover 1 is reversibly open and closed relative to said lower withdrawal cover 2.

Said hinge structure 11 comprises two parallel support portions 111 and a hinge shaft 112 with both ends fixed at said support portions 111 respectively, and said support portions 111 are fixed at the joint between the upper flap cover 1 and the lower withdrawal cover 2; said hinge shaft 112 is a cylindrical rod arranged at a spacing from said upper flap cover 1, and said clamping slot 21 is extended in the spacing and elastically clamped with said hinge shaft 112.

Said clamping slot 21 is integrated with said lower withdrawal cover 2 by an elastic material, an opening of said clamping slot 21 faces downward, and said hinge shaft 112 is inserted into or pulled out of the opening.

An oval wet tissue withdrawal opening is formed on said lower withdrawal cover 2, a raised ring wall 22 is formed at an edge of said withdrawal opening, and an upper surface of said ring wall 22 is closely fitted with a lower surface of said upper flap cover 1 when said upper flap cover 1 and said lower withdrawal cover 2 are closed, preventing ingress of external dust and impurities, and keeping wet tissues clean and sanitary.

With the technical means, the application improves the connecting structure between the upper flap cover 1 and the lower withdrawal cover 2. The arrangement of the hinge structure 11 and the clamping slot 21 on said upper flap cover 1 and said lower withdrawal cover 2 respectively helps avoid the problems that the upper flap cover 1 and the lower withdrawal cover 2 of an existing wet tissue flap cover break easily and cannot be replaced, and realize quick detachment and replacement of the wet tissue flap cover, thus guaranteeing the tightness, safety and hygiene of the wet tissue flap cover, avoiding bacteria breeding and moisture loss of wet tissues, and guaranteeing the use effect of wet tissues by users.

Such embodiments are only used to describe the invention, but not limit the scope thereof. Any equal changes and modifications made to the invention by a person skilled in the art shall fall into the scope of claims attached to the invention.

The invention claimed is:

1. A quick-detachable and replaceable wet tissue flap cover, comprising:

an upper flap cover;

a lower withdrawal cover;

a hinge structure arranged at a joint between said upper flap cover and said lower withdrawal cover; and a clamping slot connected with said hinge structure arranged at the joint between said lower withdrawal cover and said upper flap cover, said clamping slot being formed on said lower withdrawal cover, and said clamping slot having an elongated U-shaped opening, wherein said clamping slot is elastically clamped with said hinge structure, wherein the upper flap cover avoids breakage by quickly detaching from the lower withdrawal cover, wherein said upper flap cover is reversibly opened and closed relative to said lower withdrawal cover, wherein an oval wet tissue withdrawal opening is formed on said lower withdrawal cover, wherein a first vertically raised ring wall is integrally formed as one piece with the lower withdrawal cover at an edge of said withdrawal opening, wherein an upper surface of said first vertically raised ring wall is closely fitted with a lower surface of said upper flap cover when said upper flap cover closes said oval wet tissue withdrawal opening of the lower withdrawal cover, and wherein a second vertically raised ring wall is integrally formed as one piece with the lower withdrawal cover at an edge of said lower withdrawal cover.

2. The quick-detachable and replaceable wet tissue flap cover according to claim 1, wherein said hinge structure comprises two parallel support portions and a hinge shaft with both ends fixed at said support portions respectively, wherein said support portions are fixed at the joint between the upper flap cover and the lower withdrawal cover, wherein said hinge shaft is a cylindrical rod arranged at a spacing from said upper flap cover, and wherein said clamping slot is extended in the spacing and elastically clamped with said hinge shaft.

3. The quick-detachable and replaceable wet tissue flap cover according to claim 1, wherein said clamping slot is integrated with said lower withdrawal cover by an elastic material, wherein said elongated U-shaped opening of said clamping slot faces downward, and wherein said hinge shaft is inserted into or pulled out of said elongated U-shaped opening.

4. The quick-detachable and replaceable wet tissue flap cover according to claim 1, wherein the upper surface of said first vertically raised ring wall comprises a curved surface, and wherein the lower surface of said upper flap cover comprises a curved surface.

* * * * *